US008203509B2

(12) United States Patent
Onozawa et al.

(10) Patent No.: US 8,203,509 B2
(45) Date of Patent: Jun. 19, 2012

(54) PLASMA DISPLAY DEVICE AND CAPACITIVE LOAD DRIVING CIRCUIT

(75) Inventors: Makoto Onozawa, Yokohama (JP); Tomokatsu Kishi, Yamato (JP); Hideaki Ohki, Tokyo (JP); Masaki Kamada, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 901 days.

(21) Appl. No.: 12/218,061

(22) Filed: Jul. 11, 2008

(65) Prior Publication Data

US 2008/0284685 A1 Nov. 20, 2008

Related U.S. Application Data

(63) Continuation of application No. 11/282,112, filed on Nov. 18, 2005, now Pat. No. 7,768,480.

(30) Foreign Application Priority Data

Nov. 19, 2004 (JP) ..... 2004-336232

(51) Int. Cl.
*G09G 3/28* (2006.01)
*G09G 3/20* (2006.01)

(52) U.S. Cl. ..... 345/70; 345/55; 345/60

(58) Field of Classification Search ..... 345/60
See application file for complete search history.

(56) References Cited

U.S. PATENT DOCUMENTS 3,700,916 A * 10/1972 Vittoz ..... 377/115
3,786,485 A * 1/1974 Wojcik ..... 345/70
4,333,039 A 6/1982 Strom
4,648,021 A * 3/1987 Alberkrack ..... 363/157
5,552,677 A 9/1996 Pagones
6,686,912 B1 2/2004 Kishi et al.
7,242,399 B2 7/2007 Onozawa et al.
7,348,940 B2 * 3/2008 Cho et al. ..... 345/66
7,768,480 B2 8/2010 Onozawa et al.
2002/0097203 A1 7/2002 Onozawa et al.
2002/0175883 A1 11/2002 Onozawa et al.
2004/0212564 A1 10/2004 Lee et al.

FOREIGN PATENT DOCUMENTS

AU 731 140 1/2000

(Continued)

OTHER PUBLICATIONS

Chinese Patent Office Action, mailed Sep. 28, 2007 and issued in corresponding Chinese Patent Application No. 200510123475.0.

(Continued)

*Primary Examiner* — Alexander S Beck
*Assistant Examiner* — Charles V Hicks
(74) *Attorney, Agent, or Firm* — Staas & Halsey LLP

(57) ABSTRACT

A problem is to be solved that there is to be provided a plasma display device capable of generating driving signals with less variation in delay time and without carrying out any phase adjustment. There is provided a plasma display device including; a first display electrode; a second display electrode adapted to cause a discharge to occur between the first display electrode and the second display electrode; a first display electrode drive circuit for applying a discharge voltage to the first display electrode; and a second display electrode drive circuit for applying a discharge voltage to the second display electrode. The first display electrode drive circuit has a first output element for supplying a first electric potential to the first display electrode in accordance with a first input signal which is inputted by using a transformer.

3 Claims, 12 Drawing Sheets

FOREIGN PATENT DOCUMENTS

| | | |
|---|---|---|
| EP | 1 349 137 | 10/2003 |
| JP | 48-071843 | 9/1973 |
| JP | 57-97586 | 6/1982 |
| JP | 8-335863 | 12/1996 |
| JP | 2000-338934 | 12/2000 |
| JP | 2002-215087 | 7/2002 |
| JP | 2004-29850 | 1/2004 |
| JP | 2004-274719 | 9/2004 |
| JP | 2004-326104 | 11/2004 |

OTHER PUBLICATIONS

Japanese Office Action issued Jan. 26, 2010 in corresponding Japanese Patent Application 2004-336232.

Office Action mailed Nov. 12, 2009 in parent U.S. Appl. No. 11/282,112.

Office Action mailed Jun. 30, 2009 in parent U.S. Appl. No. 11/282,112.

Office Action mailed Apr. 1, 2009 in parent U.S. Appl. No. 11/282,112.

Japanese Office Action issued Jan. 26, 2010 in corresponding Japanese Patent Application No. 2004-336232.

European Search Report issued on Sep. 17, 2008, in corresponding European Patent Application No. 05257091.

Notice of Allowance mailed Mar. 23, 2010 in U.S. Appl. No. 11/282,112.

* cited by examiner

PLASMA DISPLAY DEVICE AND CAPACITIVE LOAD DRIVING CIRCUIT

CROSS-REFERENCE TO RELATED APPLICATIONS

This application is a continuation of U.S. application Ser. No. 11/282,112 filed Nov. 18, 2005 now U.S. Pat. No. 7,768,480; which is based upon and claims the benefit of priority from the prior Japanese Patent Application No. 2004-336232, filed on Nov. 19, 2004, the entire contents of which are incorporated herein by reference.

BACKGROUND OF THE INVENTION

1. Field of the Invention

The present invention relates to a plasma display device and a capacitive load capacitive load driving circuit.

2. Description of the Related Art

The plasma display apparatus has been put to practical use as a flat display and is a thin display with high luminance. FIG. 1 is a diagram showing the general constitution of a three-electrode AC-driven plasma display apparatus. As shown schematically, the plasma display apparatus comprises a plasma display panel (PDP) 1 consisting of two substrates between which a discharge gas is enclosed, each substrate having a plurality of X electrodes (X1, X2, X3, . . . , Xn) and a plurality of Y electrodes (Y1, Y2, Y3, . . . , Yn) arranged adjacently by turns, a plurality of address electrodes (A1, A2, A3, . . . , Am) arranged in the direction perpendicular to the X and Y electrodes and phosphors arranged at the crossings, an address driver 2 which applies an address pulse or the like to the address electrode, an X common driver 3 which applies a sustain discharge pulse or the like to the X electrodes, a scan driver 4 which applies a scan pulse or the like sequentially to the Y electrodes, a Y common driver 5 which supplies a sustain discharge pulse or the like, to be applied to the Y electrodes, to the scan driver 4, and a control circuit 6 which controls each part, wherein the control circuit 6 has a display data control section 7 which further includes a frame memory and a drive control circuit 8 including a scan driver control section 9 and a common driver control section 10. The display data control section 7 inputs a clock CLK and a display data DATA, and the drive control circuit 8 inputs a vertical sync signal Vsync and a horizontal sync signal Hsync. The X common driver 3 and the Y common driver 5 respectively include sustain circuits which output sustain pulses, and each sustain circuit has a sustain output element. As the plasma display apparatus is widely known, a detailed description about the whole apparatus is not given here but only the X common driver 3 and the Y common driver 5 relating to embodiments of the present invention are described here.

FIG. 2 is a block diagram showing the general constitution of the power transistor drive circuit disclosed in the Patent document 1 stated below, and the whole is provided in an IC 11 as shown by the dotted line. In the plasma display apparatus, the power transistor drive IC in FIG. 2 is used as a pre-drive circuit for driving a sustain output element. In the power transistor drive IC 11 shown in FIG. 2, a high level input voltage HIN is amplified in an input amplifier circuit 21, converted into a voltage referred to a high level reference voltage Vr in a high level shift circuit 22, and outputted as a high level output voltage HO via an output amplifier circuit 23. On the other hand, a low level input voltage LIN is amplified in an input amplifier circuit 24 and outputted as a low level output voltage LO after input into an output amplifier circuit 26 via a delay circuit 25 and amplified therein.

Reference numbers 12 and 13 respectively denote input terminals of the high level input voltage HIN and the low level input voltage LIN, reference number 16 and 19 respectively denote output terminals of the high level output voltage HO and the low level output voltage LO, reference number 15 denotes a supply terminal of a high level supply voltage Vc, reference number 17 denotes a supply terminal of the high level reference voltage Vr, reference number 18 denotes a supply terminal of a low level supply voltage Vd, and reference number 20 denotes a ground terminal.

In the power transistor drive IC shown in FIG. 2, the delay circuit 25 serves to adjust the difference tdLH (HO) in the rise times between the high level input voltage HIN and the high level output voltage HO and the difference tdLH (LO) in the rise times between the low level input voltage LIN and the low level output voltage LO so that they are equal. Moreover, the delay circuit 25 also serves to adjust the difference tdHL (HO) in the fall times between the high level input voltage HIN and the high level output voltage HO and the difference tdHL (LO) in the fall times between the low level input voltage LIN and the low level output voltage LO so that they are equal. However, it is impossible for the delay circuit 25 to make tdLH (HO) and tdLH (LO) coincide with each other perfectly, and it is inevitable that a certain difference occurs. Similarly, it is also impossible to make tdHL (HO) and tdHL (LO) coincide with each other perfectly, and it is inevitable that a certain difference occurs.

When the power transistor drive IC shown in FIG. 2 is used as a pre-drive circuit in a plasma display apparatus, sustain output elements such as a power MOSFET and an IGBT (Insulated Gate Bipolar Transistor) are connected to the output terminals 16 and 19. In a plasma display apparatus (PDP apparatus), a sustain pulse is generated, by turning on/off a sustain output element, and is supplied to the X electrode and the Y electrode of a plasma display panel (PDP).

FIG. 3 shows an example of a sustain circuit in a PDP apparatus, where the power transistor drive IC in FIG. 2 is used as a pre-drive circuit 11A and a pre-drive circuit 11B of the sustain output elements. In FIG. 3, CU and CD denote the sustain output elements, and by turning on/off these output elements, a sustain pulse is supplied to the PDP corresponding to a capacitive load. In FIG. 3, an input signal CUI is inputted as a high level input voltage of the pre-drive circuit 11A and supplied to the output element CU as a high level output voltage. On the other hand, an input signal CDI is inputted as a low level input voltage of the pre-drive circuit 11A and supplied to the output element CD as a low level output voltage.

When the output element CU is turned on, a supply voltage Vs is supplied to the PDP via a diode D1 and the output element CU (at this time the output element CD is off). When the output element CD is turned on, a ground (GND) voltage is supplied to the PDP via the output element CD (at this time the output element CU is off). On the other hand, the supply voltage of the pre-drive circuit 11A for driving the output element CU (high level supply voltage maintained across a capacitor C1) is charged across the capacitor C1 from a power supply Ve via a diode D2. The supply voltage of the pre-drive circuit 11A for driving the output element CD (low level supply voltage maintained across a capacitor C2) is charged directly across the capacitor C2 from the power supply Ve. In the circuit shown in FIG. 3, a sustain pulse is supplied to the PDP by turning on/off the output elements CU and CD alternately.

LU and LD in FIG. 3 are power recovery output elements and the power supplied to the PDP through the CU and CD is reduced by turning on/off the LU and the LD. In FIG. 3, an input signal LUI is inputted as a high level input voltage of the pre-drive circuit and supplied to the output element LU as a high level output voltage. An input signal LDI is inputted as a low level input voltage of the pre-drive circuit and supplied to the output element LD as a low level output voltage.

When the output element LU is turned on, a middle point voltage Vp of capacitors C5 and C6 connected in series between the supply voltage Vs and the GND is supplied to the PDP via the output element LU, a diode D4 and a coil L1 (at this time, the output element LD is off). On the other hand, when the output element LD is turned on, the above-mentioned middle point voltage Vp is supplied to the PDP via a coil 2, a diode D5 and the output element LD (at this time, the output element LU is off). The supply voltage (high level supply voltage maintained across a capacitor C3) of the pre-drive circuit for driving the output element LU is charged across the capacitor C3 from the power supply Ve via a diode D3. On the other hand, the supply voltage (low level supply voltage maintained across a capacitor C4) of the pre-drive circuit for driving the output element LD is charged across the capacitor C4 directly from the power supply Ve. In the circuit shown in FIG. 3, the output element LU is turned on immediately before the sustain output element CU is turned on, and the output element LD is turned on immediately before the output element CD is turned on and, thus, the power loss caused by the CU and the CD is reduced.

In the circuit shown in FIG. 3, a switch SW1 is turned on during the reset period of the plasma display apparatus and serves to supply a reset voltage Vw to the PDP via the output element CU.

Furthermore, in the patent document 2 below, a description is given on a method and a circuit for driving power transistors and integrated circuits including the above circuit.

[Patent document 1] Japanese Patent Application Laid-Open No. 2004-274719

[Patent document 2] Japanese Patent No. 3069043

In the circuit shown in FIG. 2 great variations in delay time may be caused by slow transmission speed. As a result there has been a need to keep long a period like a gap in time (a period in which both CU and CD are kept being turned off) in order to ensure the timing margin between the driving pulse to be supplied to the high side element CU of the sustain output elements and the driving pulse to be supplied to the low side element CD of the sustain output elements. This has been the obstacle to reducing of a sustain period to increase the number of the sustaining pulse.

Furthermore, great delay time to be caused, as the case may be, would lead to a larger variation in on-timing between the element for the electric power recovery LU and the high side element CU of the sustain output elements and a variation in on-timing between the element for the electric power recovery LD and the low side element CD of the sustain output elements, with the result that there has been the probability of decrease in the electric power recovery efficiency. Furthermore, reduction in the driving margin in the ALIS method poses a problem.

In order to overcome this problem, there has been a need to carry out a phase adjustment or the like, resulting in an increase in cost due to the phase adjustment circuit to be provided additionally and increase in the adjustment man-hour.

SUMMARY OF THE INVENTION

An object of the present invention is to provide a plasma display device and a capacitive load capacitive load driving circuit, which can generate driving signals with less variation in the delay time without carrying out any phase adjustment.

Another object of the present invention is to provide a plasma display device and a capacitive load driving circuit, which can increase the number of the sustaining pulse and increase the electric power recovery efficiency by carrying out adjustment with higher accuracy than hitherto, even in the event of carrying out the phase adjustment, and make the driving margin wider even in the event of employing the ALIS method.

In one aspect of the present invention, a plasma display device is provided, which comprises; a first display electrode; a second display electrode adapted to cause a discharge to occur between the first display electrode and the second display electrode; a first display electrode driving circuit which applies a discharge voltage to the first electrode; and a second display electrode driving circuit which applies a discharge voltage to the second electrode. The first display electrode driving circuit has a first output element for supplying a first electric potential to the first display electrode in accordance with the first input signal which is inputted through a transformer.

DETAILED DESCRIPTION OF THE PREFERRED EMBODIMENTS

In the following, an explanation is given on the embodiments of the present invention using drawings.

First Embodiment

Figure 1:
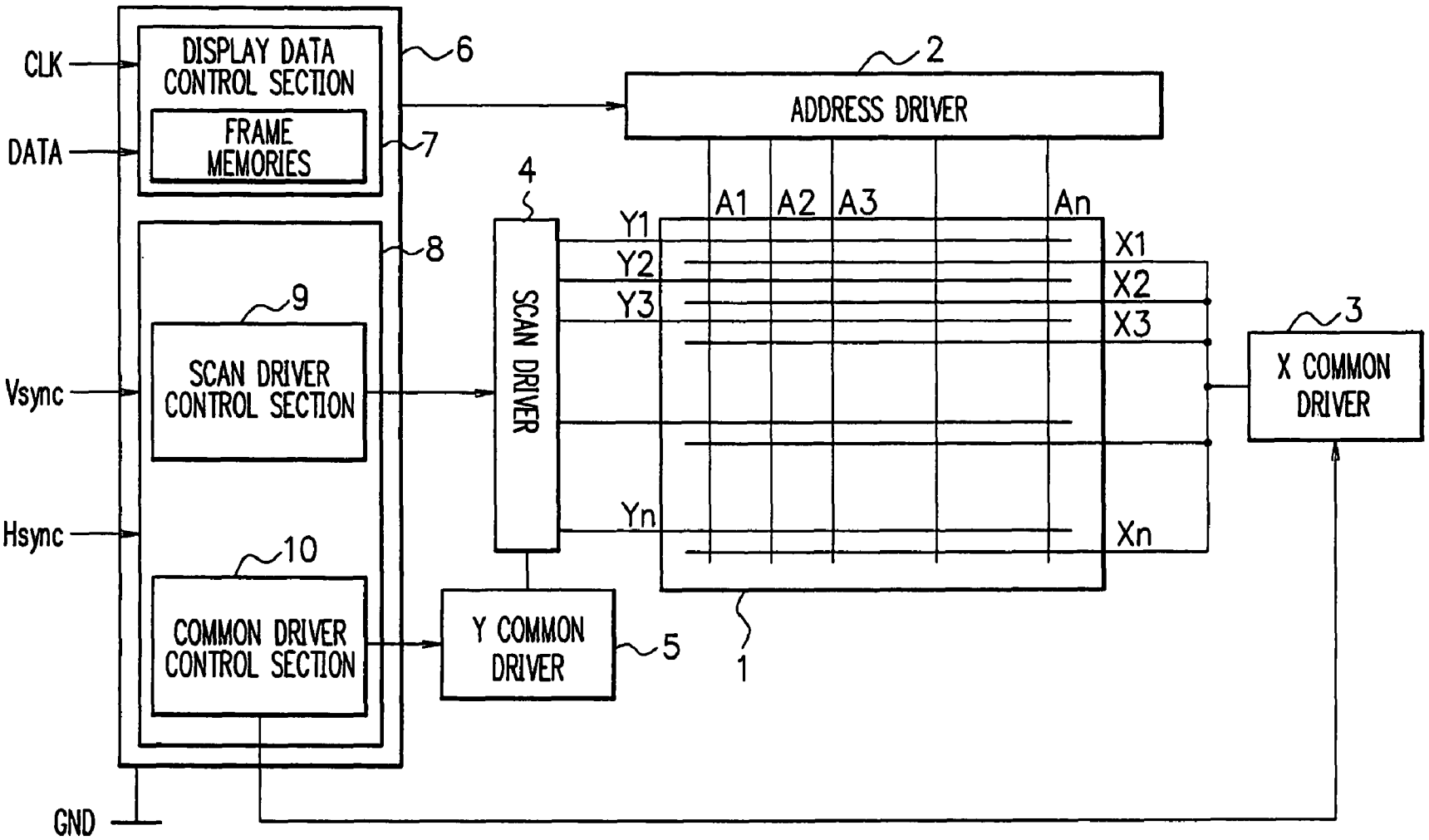
FIG. 1 shows an entire configuration of an AC driving type plasma display device.

The plasma display device according to the first embodiment of the present invention has a whole configuration shown in FIG. 1. Details thereof are the same as those in the explanation on FIG. 1 given above. Hereinafter, the X electrodes X1 to Xn are respectively or generically are referred to as the X electrode Xi, and the Y electrodes Y1 to Yn are respectively or generically referred to as the Y electrode Yi. The X electrode Xi and the Y electrode Yi are display electrodes, and have an insulator therebetween to constitute a capacitive load. The Y common driver 5 is a capacitive load driving circuit of the Y electrode, where the driving circuit supplies the sustaining pulse to the Y electrode Yi to cause a sustain discharge to occur between the X electrode Xi and the Y electrode Yi. The X common driver 3 is a capacitive load driving circuit of the X electrode, where the driving circuit supplies the sustaining pulse to the X electrode Xi to cause a sustain discharge to occur between the X electrode Xi and the Y electrode Yi. Because the X common driver 3 and the Y common driver have configuration similar to each other, an explanation is given about the Y common driver 5, as an example, as follows.

Figure 4:
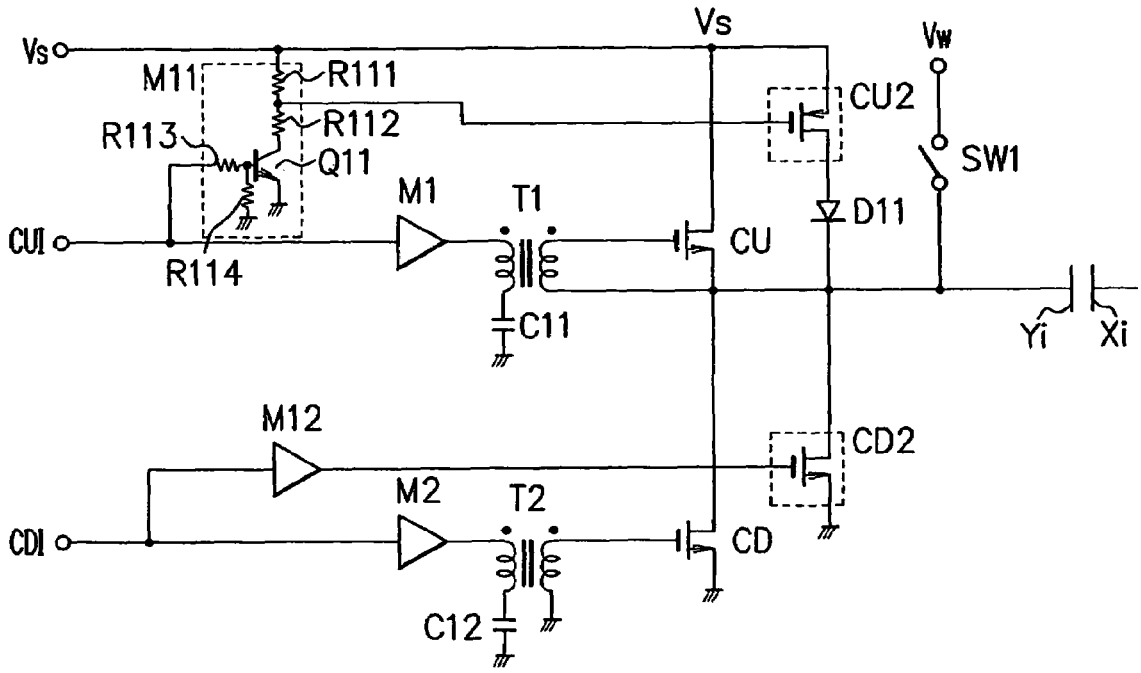
FIG. 4 is a circuit diagram of an example of configuration of the Y common driver according to the first embodiment of the present invention.

FIG. 4 shows is a circuit diagram of an example of configuration of the Y common driver (Y sustain drive circuit) 5 shown in FIG. 1 according to the first embodiment of the present invention.

Figure 5:
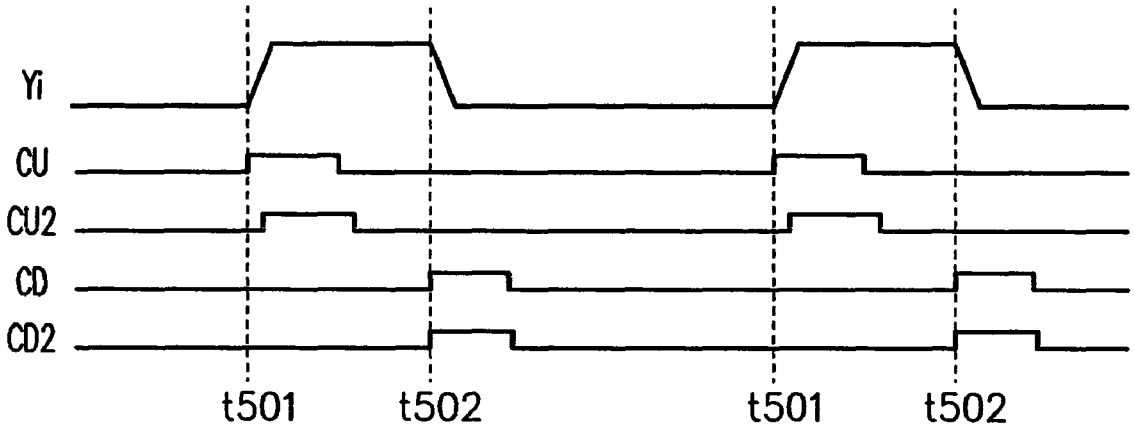
FIG. 5 shows a timing chart for explaining the operation of the Y common driver shown in FIG. 4.

The amplifying circuit M1 amplifies and outputs a signal to be inputted from an input terminal CUI. A transformer T1 has a primary winding and a secondary winding. The output of the amplifying circuit M1 is connected to the ground through the primary winding of a transformer T1 and a capacitor C11. The secondary winding of the transformer T1 is connected between a gate of an N-channel power MOS field effect transistor (FET) CU and the Y electrode Yi. In the following, a power MOSFET is referred to as a MOS transistor. The source and the drain of the MOS transistor CU are connected to the Y electrode Yi and a positive source voltage Vs, respectively. The source voltage Vs is, for example, 180V. The reference potential of the MOS transistor CU is the potential of the Y electrode Yi to which the source of the MOS transistor is connected. The potential of the Y electrode Yi varies as shown in FIG. 5 from 0V to the source voltage Vs. A transformer T1 is able to change the input signal with the ground being a reference and fed from the input terminal CUI to a signal with the potential of the Y electrode Yi being a reference, and outputs it to the gate of the MOS transistor CU. By the way, details of FIG. 5 are described later.

A P-channel MOS transistor CU2 is connected parallel to the MOS transistor CU. The gate of the MOS transistor CU2 is connected to the input terminal CUI through a drive circuit M11. The source and the drain of the MOS transistor CU2 are connected, respectively, to the source voltage Vs and an anode of a diode D11. The cathode of the diode D11 is connected to the Y electrode Yi. By providing the drive circuit M11 and the diode D11, the MOS transistor CU2 can be driven.

Next, the configuration of the drive circuit M11 is explained. A resistor R111 is connected between the source voltage Vs and the gate of the MOS transistor CU2. A resistor R112 is connected between the gate of the MOS transistor CU2 and a collector of an NPN junction bipolar transistor Q11. The emitter of the bipolar transistor Q11 is connected to the ground. A resistor R113 is connected between the input terminal CUI and the base of the bipolar transistor Q11. A resistor R114 is connected between the base of the bipolar transistor Q11 and the ground.

An amplifying circuit M2 amplifies and outputs a signal inputted from an input terminal CDI. A transformer T2 has a primary winding and a secondary winding. Output of the amplifying circuit M2 is connected to the ground through the primary winding of a transformer T2 and a capacitor C12. The secondary winding of the transformer T2 is connected between a gate of an N-channel MOS transistor CD and the ground. The source and the drain of the MOS transistor CD are connected, respectively, to the ground and the Y electrode Yi.

A drive circuit M12 is an amplifying circuit, which amplifies and outputs an input signal from the input terminal CDI. An N-channel MOS transistor CD2 has a gate connected to the output terminal of the amplifying circuit M12, a source connected to the ground, and a drain connected to the Y electrode Yi.

The MOS transistor CU inputs a signal by using a transformer T1 and supplies the source voltage (high level) Vs to the Y electrode Yi in accordance with the input signal. The MOS transistor CU2 inputs a signal without using a transformer and supplies the source voltage Vs to the Y electrode Yi in accordance with the input signal. The MOS transistor CD inputs a signal by using a transformer T2 and supplies the ground (low level) to the Y electrode Yi in accordance with the input signal. The MOS transistor CD2 inputs a signal without using a transformer and supplies the ground to the Y electrode Yi in accordance with the input signal.

By the way, a switch SW1 is turned on during a reset period of the plasma display device and functions to supply a reset voltage Vw to the Y electrode Yi.

Figure 2:
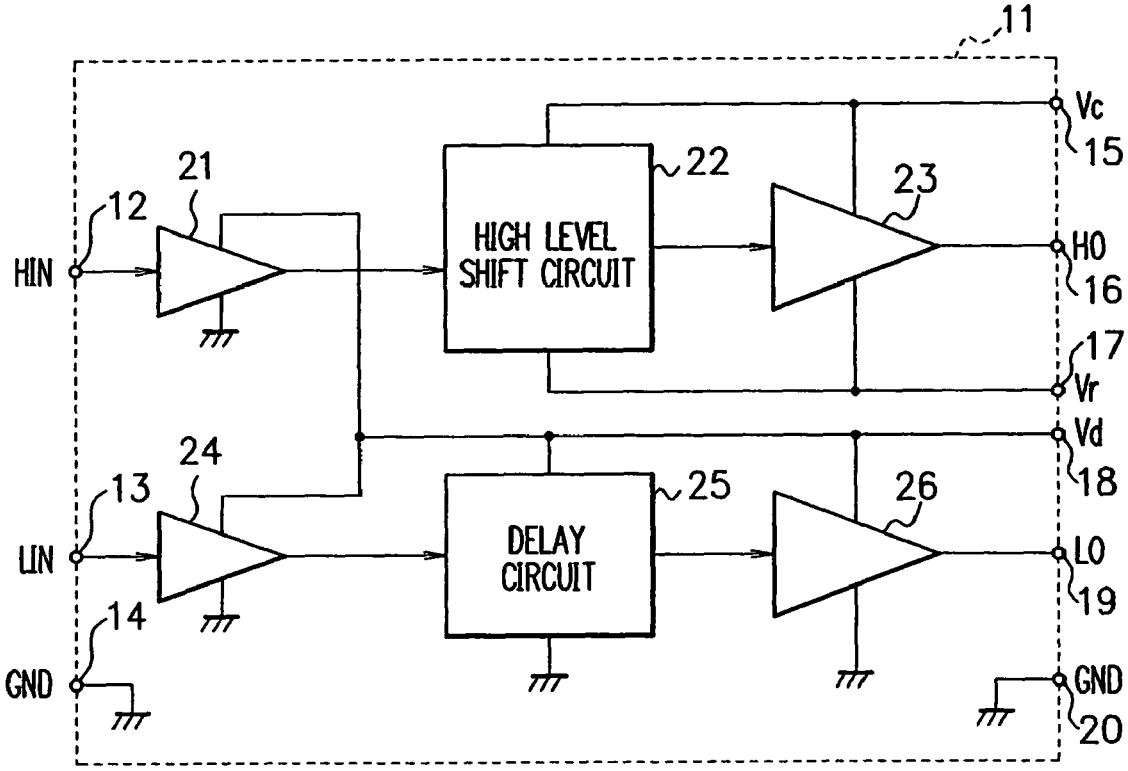
F I G. 2 PRIOR ART
FIG. 2 shows a power transistor drive circuit in prior art.

In the present embodiment, by using the transformers T1 and T2 as the drive circuits of the MOS transistors CU and CD, the MOS transistors CU and CD can be driven faster as compared to the case where there is used the circuit shown in FIG. 2. The transformers T1 and T2 can transmit high frequency signals, but they have difficulties in transmitting low frequency signals. Then, the MOS transistor for low frequency use CU2 is connected parallel to the MOS transistor CU, and the MOS transistor for low frequency use CD2 is connected parallel to the MOS transistor CD. In the case where low frequency signals are inputted to the input terminals CUI and CDI, the MOS transistors CU2 and CD2 are turned on.

FIG. 5 shows a timing chart for explaining the operation of the Y common driver 5 shown in FIG. 4. By operations of the MOS transistors CU, CU2, CD, and CD2, the sustaining pulse is supplied to the Y electrode Yi. Waveforms of the MOS transistors CU, CU2, CD, and CD2 are such that a high level shows an "on" state (conductive) and a low level shows an "off" state (non-conductive). An N-channel MOS transistor is turned "on" when the gate is at a high level. A P-channel MOS transistor is turned "on" when the gate is at a low level.

First, at time t501, the MOS transistor CU is turned on in accordance with the input signal from the input terminal CUI, and a little bit later the MOS transistor CU2 is turned on. The drive circuit M11 connected to the MOS transistor CU2 is slower in response than the transformer T1 connected to the MOS transistor CU. The MOS transistor CU inputs an input signal from the input terminal CUI by using the transformer T1, whereas the MOS transistor CU2 inputs an input signal from the input terminal CUI by using the drive circuit M11 instead of using the transformer T1, and therefore the turning on of the MOS transistor CU2 is delayed in time.

When the transistor CU is turned on, the source voltage is supplied to the Y electrode Yi through the transistor CU. The Y electrode Yi is clamped to the source voltage Vs. Then, the transistors CU and CU2 are turned off in accordance with the input signal from the input terminal CUI. The Y electrode Yi retains the source voltage Vs.

Next, at time t502, the transistors CD and CD2 are turned on in accordance with the input signal from the input terminal CDI. The Y electrode Yi is connected to the ground through transistors CD and CD2. The Y electrode Yi is clamped to the ground. Then the transistors CD and CD2 are turned off in accordance with the input signal from the input terminal CDI. The Y electrode Yi retains the ground. Hereafter, an operation of the period t501 to t502 is repeated.

The foregoing is an explanation of the sustaining pulse of the Y electrode Yi. The sustaining pulse of the X electrode Xi is a signal in opposite phase to the sustaining pulse of the Y electrode Yi. At time t501 a voltage Vs is applied between the X electrode Xi and the Y electrode Yi. A sustain discharge for display between the X electrode Xi and the Y electrode Yi generates at around t501 and light is emitted. In the same way, at around a time when the Y electrode Yi is grounded and the X electrode Xi is at the source voltage Vs, a sustain discharge generates and light is emitted.

Figure 3:
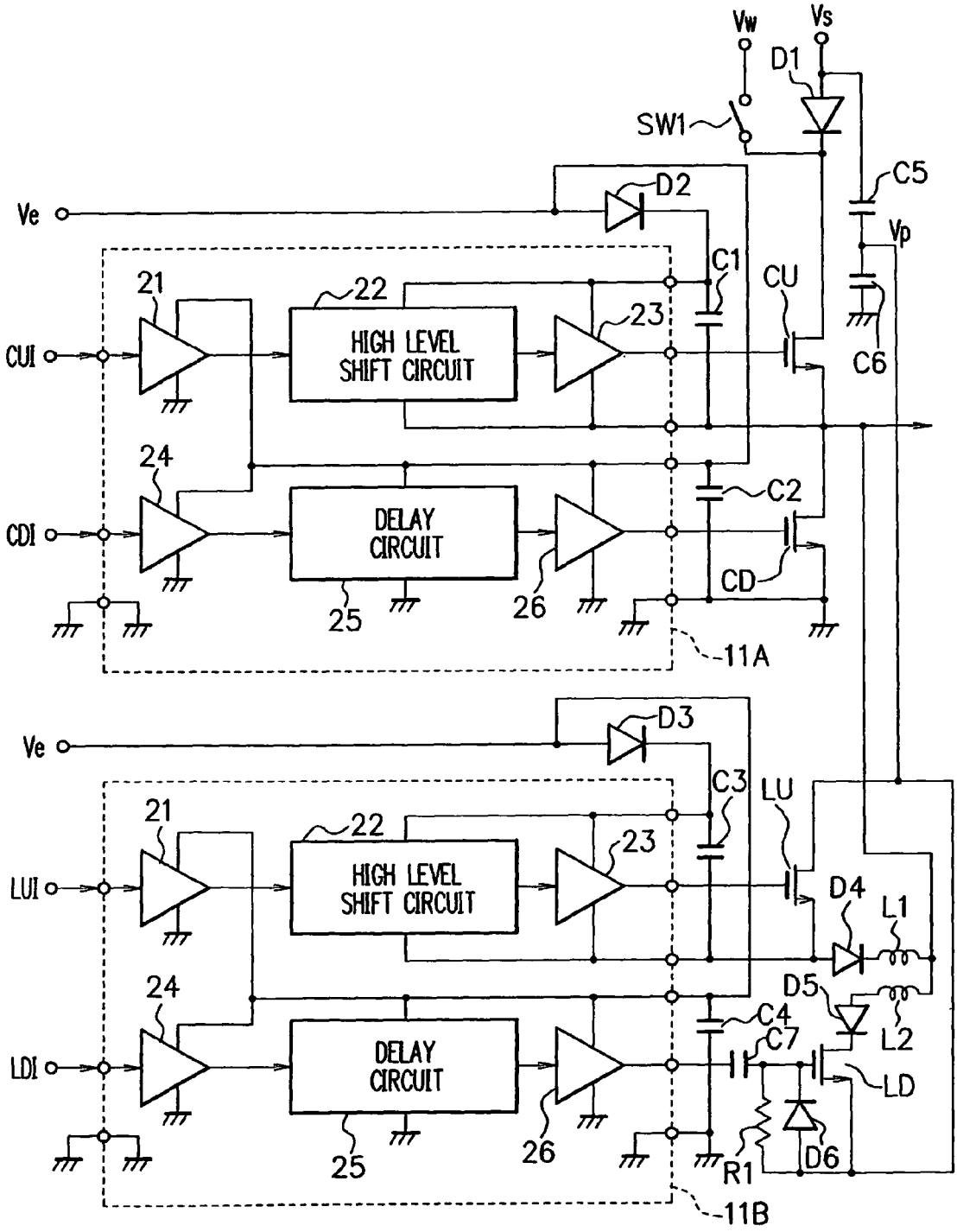
F I G. 3 PRIOR ART
FIG. 3 shows an example of a sustain circuit in prior art.

In the circuit shown in FIG. 3, the power transistor driving IC shown in FIG. 2 is used for driving the MOS transistors CU and CD shown in FIG. 3. On the contrary, in the present embodiment, the transformers T1 and T2 are used in place of the power transistor driving IC.

In the present embodiment, by using the transformers T1 and T2 as drive circuits of the MOS transistors (output elements) CU and CD, the MOS transistors CU and CD can be driven faster than the case where the circuit shown in FIG. 2 is used. That is, a time period to ensure the timing margin described above can be short. Therefore in the present embodiment the MOS transistors CU and CD can be driven faster without doing an adjustment between the delay times in input and output signals necessary in the case where the circuit shown in FIG. 2 is used. Then, it becomes possible to shorten the period of the sustaining pulse, to increase the number of the sustaining pulse, and to increase the brightness of the plasma display device. Furthermore, a variation in delay time of the gate signal of the MOS transistors CU and CD can be reduced.

In a case where transformers T1 and T2 are used, in order to generate the sustaining pulse the MOS transistors CU and CD can be driven at high frequency, but it is difficult to clamp plasma display panel at the source voltage Vs or the ground for a long period. Then the MOS transistor for low frequency use (output element) CU2 is connected in parallel to the MOS transistor CU, and the MOS transistor for low frequency use (output element) CD2 is connected in parallel to the MOS transistor CD. In a case where the Y electrode Yi is clamped for a long period, these MOS transistors CU2 and CD2 are made conductive. The drive circuit M11 is a drive circuit for the MOS transistors CU2. The amplifying circuit M12 is a drive circuit for the MOS transistor CD2. In the present embodiment, the MOS transistor CU and CU2 have the same input signal from the input terminal CUI and are driven by it, and the MOS transistor CD and CD2 have the same input signal from the input terminal CDI and are driven by it. In this case it is preferable to drive in such a way that turning on the MOS transistor CD is after the MOS transistor CU2 is turned off, and turning on the MOS transistor CU is after the MOS transistor CD2 is turned off.

Furthermore, by supplying independent driving signals to the MOS transistors CU2 and CD2, by turning on only the MOS transistors CU and CD during the sustain period, and by making the MOS transistors CU2 and CD2 conductive in the case where supplying a signal with a period longer than the sustaining pulse is supplied to the Y electrode Yi of the plasma display panel, the driving sequence becomes free, which enables faster driving.

Second Embodiment

Figure 6:
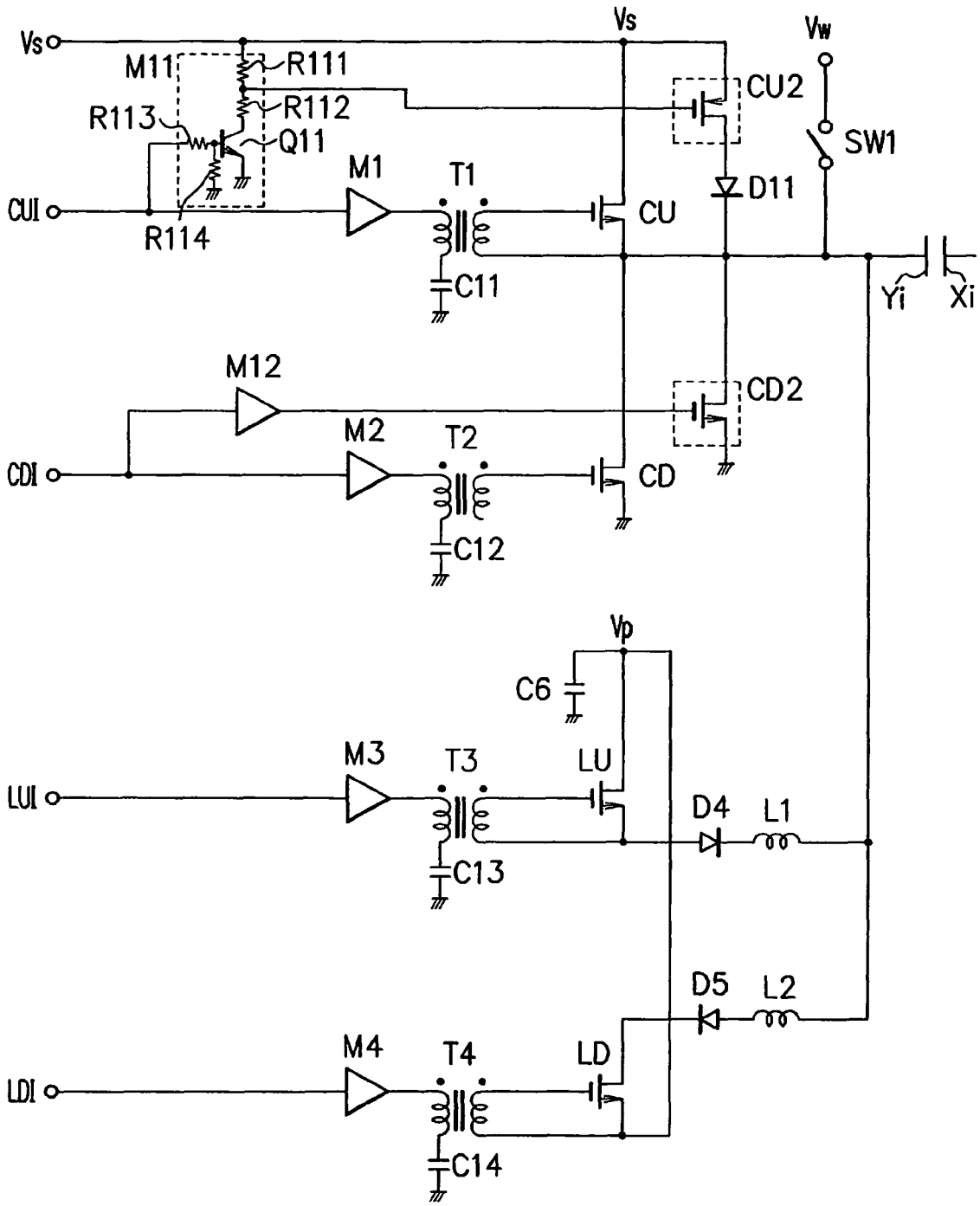
FIG. 6 is a circuit diagram of an example of configuration of the Y common driver according to the second embodiment of the present invention.

FIG. 6 shows a circuit diagram of an example of configuration of the Y common driver (Y sustain drive circuit) 5 shown in FIG. 1 according to the second embodiment of the present invention. The circuit shown in FIG. 6 is basically the same as the circuit shown in FIG. 4, and is added by an electric power recovery circuit described below.

The amplifying circuit M3 amplifies and outputs a signal inputted from an input terminal LUI. A transformer T3 has a primary winding and a secondary winding. Output of the amplifying circuit M3 is connected to the ground through the primary winding of a transformer T3 and a capacitor C13. The secondary winding of the transformer T3 is connected between a gate and a source of an N-channel MOS transistor (output element) LU. The source and the drain of the MOS transistor LU are connected to an anode of a diode D4 and the ground through a capacitor C6, respectively. A coil L1 is connected between the cathode of the diode D4 and the Y electrode Yi. The diode D4 makes a forward current flow from an electric potential Vp of the capacitor C6 to the Y electrode Yi through the MOS transistor LU and the coil L1.

The amplifying circuit M4 amplifies and outputs a signal inputted from an input terminal LDI. A transformer T4 has a primary winding and a secondary winding. Output of the amplifying circuit M4 is connected to the ground through the primary winding of a transformer T4 and a capacitor C14. The secondary winding of the transformer T4 is connected between a gate and a source of an N-channel MOS transistor (output element) LD. The source and the drain of the MOS transistor LD are connected to the ground through the capacitor C6 and a cathode of a diode D5, respectively. A coil L2 is connected between the anode of the diode D5 and the Y electrode Yi. The diode D5 makes a forward current flow from the Y electrode Yi to the electric potential Vp of the capacitor C6 through the MOS transistor LD and the coil L2.

By the way, the electric power recovery circuit operates always at high frequency as explained later by referring to FIG. 7, and therefore does not require MOS transistors for the low frequency use such as the MOS transistor CU2 and CD2.

Furthermore, similar to the circuit shown in FIG. 3, a capacitor C5 may be connected to the capacitor C6. In this case the capacitor C5 is connected between the source potential Vs and the capacitor C6.

Figure 7:
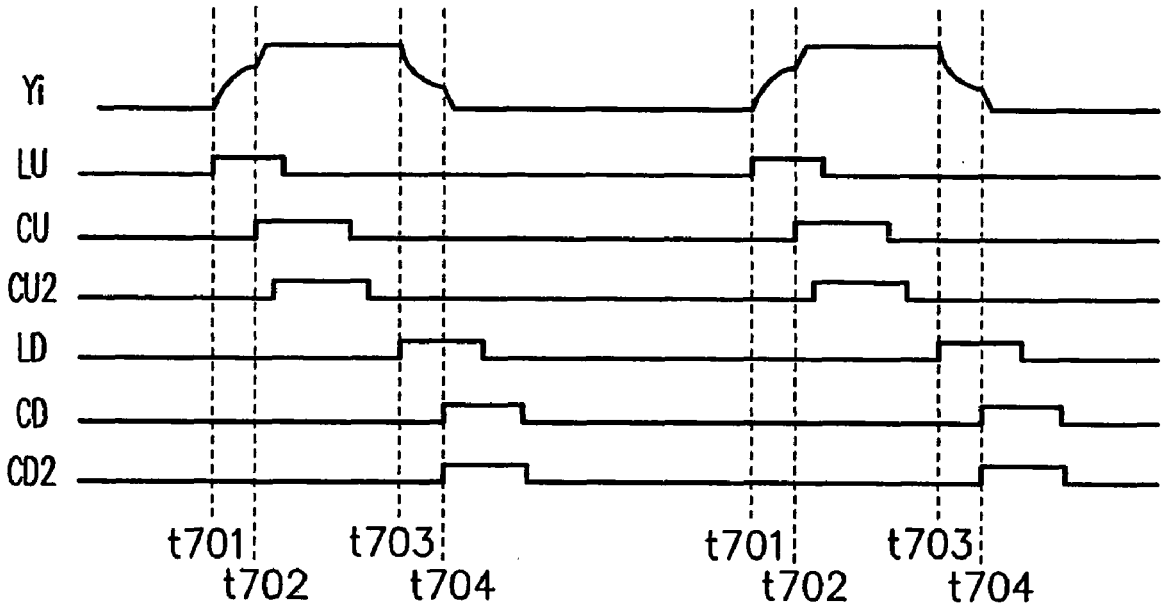
FIG. 7 shows a timing chart for explaining the operation of the Y common driver shown in FIG. 6.

FIG. 7 shows a timing chart for explaining the operation of the Y common driver 5 shown in FIG. 6. By the operations of the MOS transistors CU, CU2, CD, and CD2, a clamp is done at the source voltage Vs or the ground, and the electric power recovery is done by the MOS transistors LU and LD. Waveforms of the MOS transistors LU, CU, CU2, LD, CD, and CD2 are such that a high level shows an "on" state (conductive) and a low level shows an "off" state (non-conductive).

First, at time t701, the MOS transistor LU is turned on in accordance with the input signal from the input terminal LUI. Since the capacitor C6 is charged as explained later, the potential Vp of the capacitor C6 is supplied to the Y electrode Yi through the MOS transistor LU, the diode D4 and the coil L1 by LC resonance. The Y electrode Yi goes up toward the source voltage Vs.

Next, at time t702, the MOS transistor CU is turned on in accordance with the input signal from the input terminal CUI, and a little bit later the MOS transistor CU2 is turned on. This operation is similar to the operation at t501 shown in FIG. 5. The source voltage Vs is supplied to the Y electrode Yi through the MOS transistor CU. The Y electrode Yi is clamped at the source voltage Vs. Then the MOS transistor LU is turned off in accordance with the input signal from the input terminal LUI, and the MOS transistors CU and CU2 are turned off in accordance with the input signal from the input terminal CUI. Y electrode Yi retains the source voltage Vs.

Next, at time t703, the MOS transistor LD is turned on in accordance with the input signal from the input terminal LDI. The electric charges (electric power) of the Y electrode Yi are discharged to the potential Vp of the capacitor CG, which is connected to the ground, through the coil L2, the diode D5 and the MOS transistor LD by LC resonance. By this way, the capacitor is charged, and the electric power can be recovered. The Y electrode Yi goes down toward the ground.

Next, at time t704, the transistors CD and CD2 are turned on in accordance with the input signal from the input terminal CDI. The Y electrode Yi is connected to the ground through transistors CD and CD2. The Y electrode Yi is clamped to the ground. Then the MOS transistor LD is turned off in accordance with the input signal from the input terminal LDI, and the MOS transistors CD and CD2 are turned off in accordance with the input signal from the input terminal CDI. The Y electrode Yi retains the ground. Hereafter, operations of the period t701 to t704 are repeated.

In the present embodiment, a feature lies in a point where the transformers T3 and T4 are utilized in the drive circuit of the MOS transistors LU and LD which drive the electric power recovery circuit. The MOS transistors LU and LD are turned on during a short period (high frequency) at the rising time and at the falling time of the sustaining pulse. By driving the MOS transistors LU and LD by the transformer T3 and T4, the MOS transistors LU and LD can be driven faster than the case where the circuit shown in FIG. 2 is used. As a result, a difference in on-timing of the electric power recovery element LU and the sustain output high-side element CU and a difference in on-timing of the electric power recovery element LD and the sustain output low-side element CD are able to be set with high precision, and an increase in electric power recovery efficiency can be realized.

Third Embodiment

Figure 8:
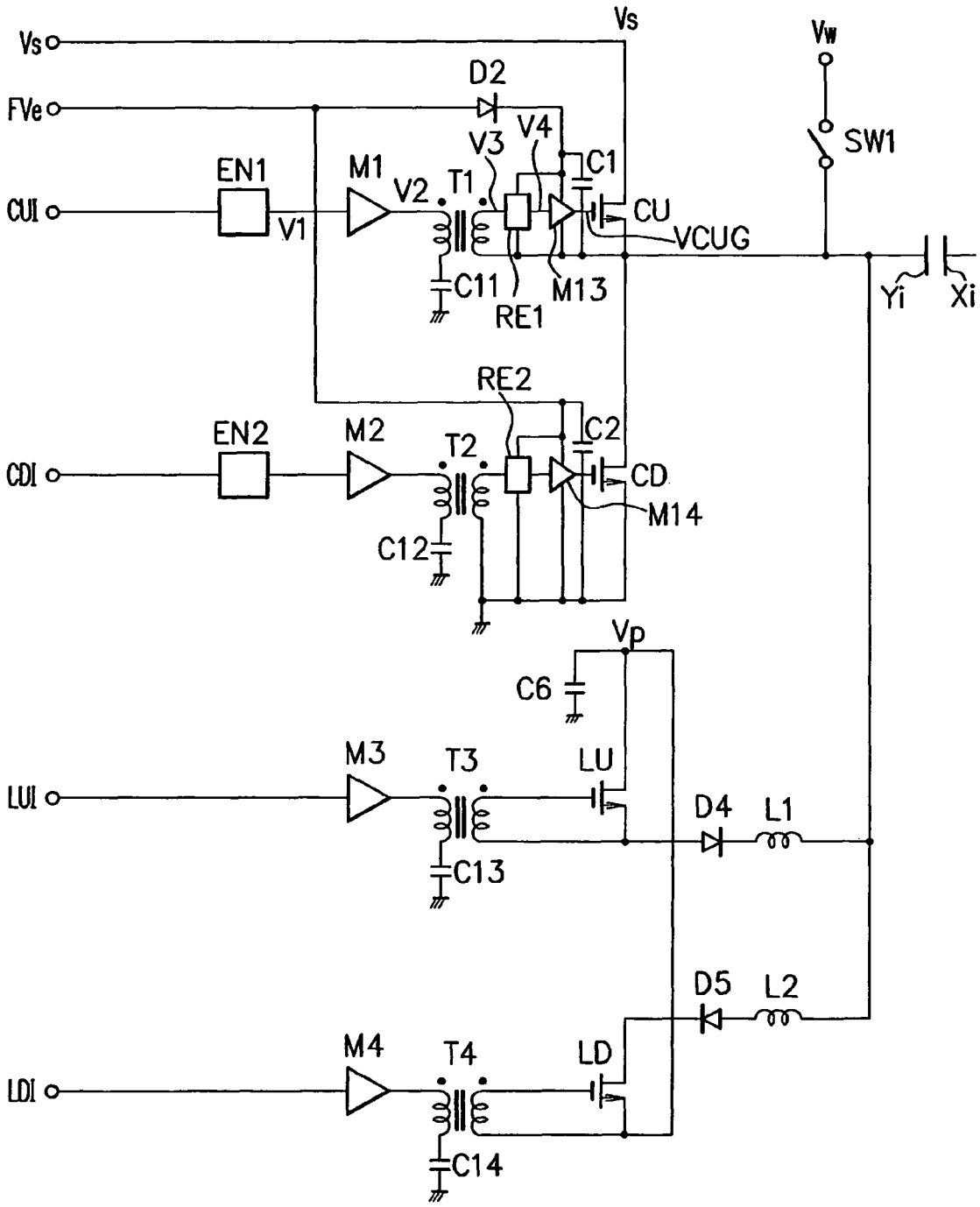
FIG. 8 shows a circuit diagram of an example of configuration of the Y common driver according to the third embodiment of the present invention.

FIG. 8 shows a circuit diagram of an example of configuration of the Y common driver (Y sustain drive circuit) 5 shown in FIG. 1 according to the third embodiment of the present invention. The circuit shown in FIG. 8 is basically the same as the circuit shown in FIG. 6, and different in the following point.

Modulation circuits EN1 and EN2, demodulation circuits RE1 and RE2, and amplifying circuits M13 and M14 are added, and by this addition the MOS transistors CU and CD can be driven not only at high frequency but also at low frequency. As a result, the MOS transistors for low frequency use CU2 and CD2 become unnecessary.

The modulation circuit EN1 is connected between the input terminal CUI and the input terminal of the amplifying circuit M1, and modulates a low frequency signal from the input terminal CUI to a high frequency signal, and outputs to the amplifying circuit M1. The demodulation circuit RE1 demodulates a high frequency signal of the secondary winding of the transformer T1 into a low frequency signal and outputs to the amplifying circuit M13. The amplifying circuit M13 amplifies a signal from the demodulator circuit RE1 and outputs to the gate of the MOS transistor CU.

An anode and a cathode of a diode D2 are connected to a floating source voltage FVe and the Y electrode Yi through a capacitor C1, respectively. The floating source voltage FVe is 15V, for example. The demodulation circuit RE1 and the amplifying circuit M13 are connected to both ends of the capacitor C1, and are supplied by the floating source voltage with the potential of the Y electrode Yi being a reference potential. The reference potential of the secondary winding of the transformer T1 is also the potential of the Y electrode Yi.

The modulation circuit EN2 is connected between the input terminal CDI and the input terminal of the amplifying circuit M2, and modulates a low frequency signal from the input terminal CDI to a high frequency signal, and outputs to the amplifying circuit M2. The demodulation circuit RE2 demodulates a high frequency signal of the secondary winding of the transformer T2 into a low frequency signal and outputs to the amplifying circuit M14. The amplifying circuit M14 amplifies the output signal from the demodulator circuit RE2 and outputs to the gate of the MOS transistor CD. A capacitor C2 is connected between the floating source voltage FVe and the ground. The demodulation circuit RE2 and the amplifying circuit M14 are connected to both ends of the capacitor C2, and are supplied by the floating source voltage with the ground being a reference potential. The reference potential of the secondary winding of the transformer T2 is also the ground.

Figure 9:
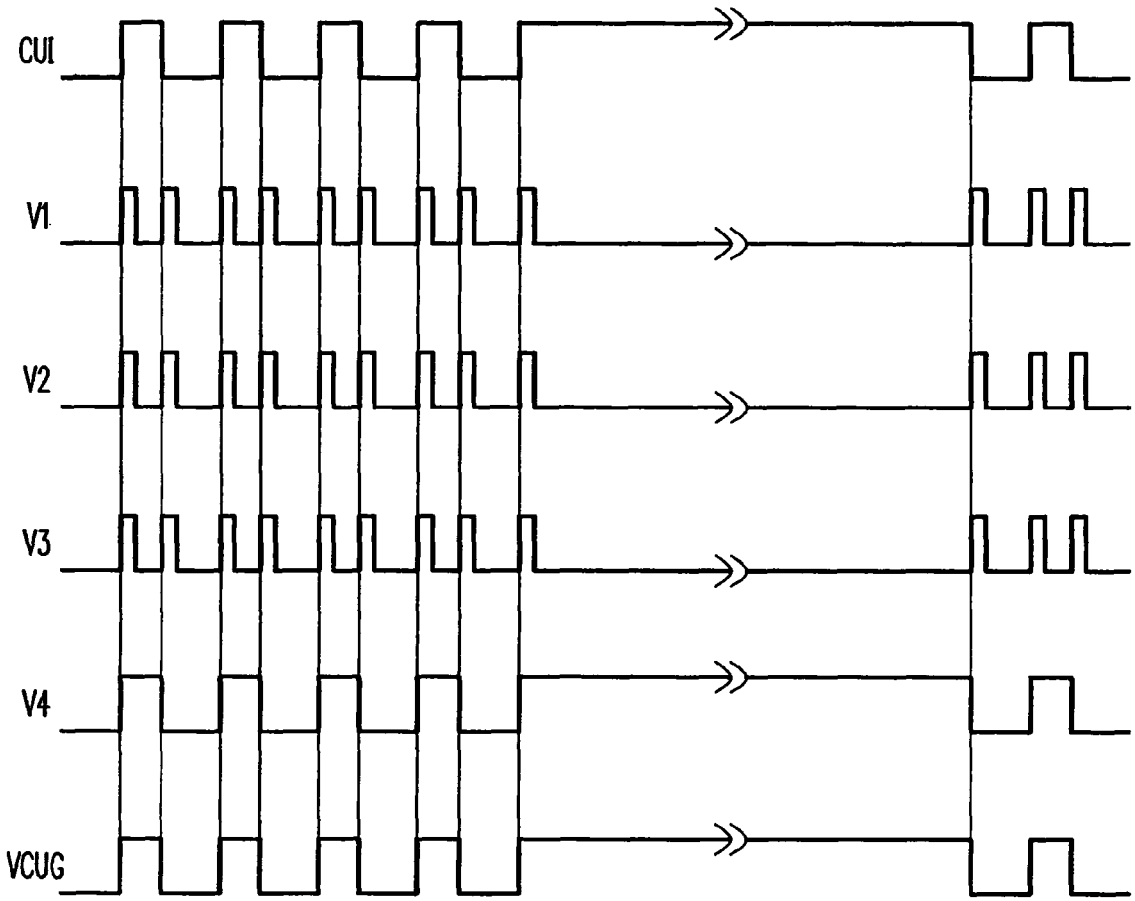
FIG. 9 shows a timing chart for explaining the operation of the Y common driver shown in FIG. 8.

FIG. 9 shows a timing chart for explaining the operation of circuit shown in FIG. 8. Voltage V1 shows an output voltage of the modulation circuit EN1. Voltage V2 shows an input voltage of the transformer T1. Voltage V3 shows an input voltage of the demodulation circuit RE1. Voltage V4 shows an output voltage of the demodulation circuit RE1. Voltage VCUG shows a gate voltage of the MOS transistor CU.

The modulation circuit EN1 outputs an edge pulse voltage V1 when a signal of a rising edge of the input signal from the input terminal CUI is input, and also outputs an edge pulse voltage V1 when a signal of a falling edge of the input signal from the input terminal CUI is inputted. By this way the modulation circuit EN1 can modulate the low frequency signal from the input terminal CUI to a high frequency signal V1. The amplifying circuit M1 amplifies the voltage V1 and outputs a voltage V2.

The transformer T1 inputs the voltage V2 with the ground being reference and outputs a voltage V3 with the potential of the Y electrode Yi being reference. Since the voltage V2 is modulated to a high frequency signal by the modulating circuits EN1, the transformer T1 can normally transmits the voltage V2 to the voltage V3, although the input signal from the input terminal CUI is a low frequency signal.

The demodulation circuit RE1 outputs a signal V4 with a rising edge or a falling edge, when the edge pulse of the voltage V3 is inputted. More concretely, the demodulation circuit RE1 reverses its level every time when the voltage V3 with edge pulse is inputted, and outputs alternatively a voltage V4 with a rising edge and a falling edge. By this way, the demodulation circuit RE1 can demodulate a high frequency signal to a low frequency signal. The amplifying circuit M13 amplifies the voltage V4 to output a voltage VCUG. As a result, the voltage VCUG becomes a signal with the same logic level as the input signal from the input terminal CUI.

By the way, operations of the modulation circuit EN2 and the demodulation circuit RE2 are the same as the operations of the modulation circuit EN1 and the demodulation circuit RE1, respectively.

The feature of the present embodiment is to use the modulation circuits EN1 and EN2, and the demodulation circuits RE1 and RE2. By the modulation circuit EN1 coding is done from a signal from the input terminal CUI to a high frequency signal, and supplies to the primary winding of the transformer T1 through the amplifying-circuit M1. In the demodulation circuit RE1 a drive pulse is regenerated from a coded high frequency signal output from the secondary winding of the transformer T1, and supplied to the MOS transistor CU through the amplifying circuit M13. The MOS transistor CD can be driven in the same way.

As a driving pulse for the MOS transistors CU and CD, a pulse with period longer than that of the sustaining pulse may also be taken into account. An example is a situation to clamp the X electrode Xi or the Y electrode Yi of the plasma display panel to the source voltage Vs or the ground for a relatively long period. Even in such a situation, to supply necessary and sufficient driving voltage to supply to the MOS transistors CU and CD, a floating source is provided for supplying source voltages to the amplifying circuits M13 and M14, and the source voltage FVe is supplied from this floating source.

In order to avoid a miss operation at the time of turning on and off the source voltage, the MOS transistors CU and CD are turned on when the signal from the input terminal CUI and CDI is in the high level, and the MOS transistors CU and CD are turned off when the signal from the input terminal CUI and CDI is in the low level. As a result, when the source voltage is low and the modulation circuits EN1 and EN2, and the demodulation circuits RE1 and RE2 are not in operation, the driving pulse of the MOS transistors CU and CD becomes in the low level, then the MOS transistors CU and CD becomes in the off state. Therefore a situation does not happen where at the time of turning on and off the source voltage, the MOS transistors CU and CD are turned on, which leads to a ruin or the like.

Fourth Embodiment

Figure 10:
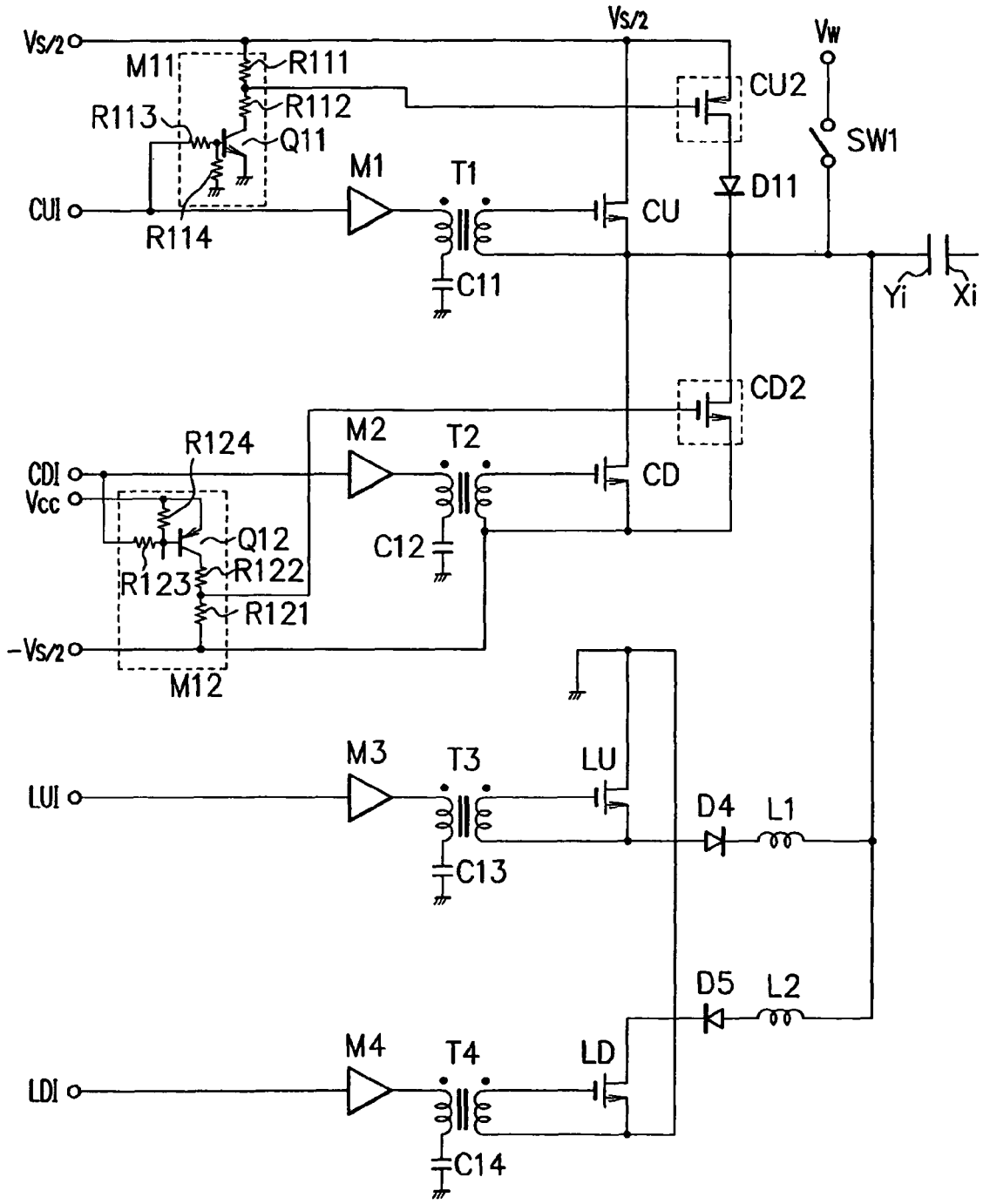
FIG. 10 shows a circuit diagram of an example of configuration of the Y common driver according to the fourth embodiment of the present invention.

FIG. 10 shows a circuit diagram of an example of configuration of the Y common driver (Y sustain drive circuit) 5 shown in FIG. 1 according to the fourth embodiment of the present invention. The circuit shown in FIG. 10 is basically the same as the circuit shown in FIG. 6, and different in the following point.

In the circuit shown in FIG. 6, the Y electrode Yi was supplied by a sustaining pulse with Vs as a high level and the ground as a low level, in the circuit shown in FIG. 10, the Y electrode Yi is supplied by a sustaining pulse with +Vs/2 as a high level and −Vs/2 as a low level.

The source voltage +Vs/2 is supplied to a resistor R111, the drain of the MOS transistor CU and the source of the MOS transistor CU2. The source voltage −Vs/2 is supplied to the secondary winding of the transformer T2, the source of the MOS transistor CD and the source of the MOS transistor CD2.

The drive circuit M12 was an amplifying circuit in FIG. 6, but it is a low level shift circuit in FIG. 10. An explanation is given below on a configuration of the low level shift circuit M12. A resistor R121 is connected between a source voltage −Vs/2 and the gate of the MOS transistor CD2. A resistor R122 is connected between the gate of the MOS transistor CD2 and the collector of the PNP junction bipolar transistor Q12. The emitter of the bipolar transistor Q12 is connected to the source voltage Vcc. The source voltage Vcc is 5V or 3V, for example. A resistor R123 is connected between the input terminal CDI and the base of the bipolar transistor Q12. A resistor R124 is connected between the source voltage Vcc and the base of the bipolar transistor Q12. The low level shift circuit M12 converts an input signal with the ground being reference pertaining to the input terminal CDI into a signal with the electric potential −Vs/2 being reference and outputs to the gate of the MOS transistor CD2.

The present embodiment has a feature wherein two source voltages +Vs/21 and −Vs/2 are used as the sustain source voltage. The circuit shown in FIG. 10 can eliminate the capacitor CG for the electric power recovery shown in FIG. 6. The drain of the MOS transistor LU and the source of the MOS transistor LD are connected to the ground. By using the transformers T1 and T2 as drive circuits for the MOS transistors CU and CD, input signals with the ground pertaining to the input terminals CUI and CDI being reference can be easily converted into driving pulses with the reference voltage being reference (the source voltage of the MOS transistor or the like.) of the output elements (the MOS transistors) CU and CD. Even in the event of carrying out a conversion into the signal with different reference voltage level, a variation in delay time can be decreased since the transformers T1 to T4 which are superior in high speed characteristics are used in this embodiment.

Fifth Embodiment

Figure 11:
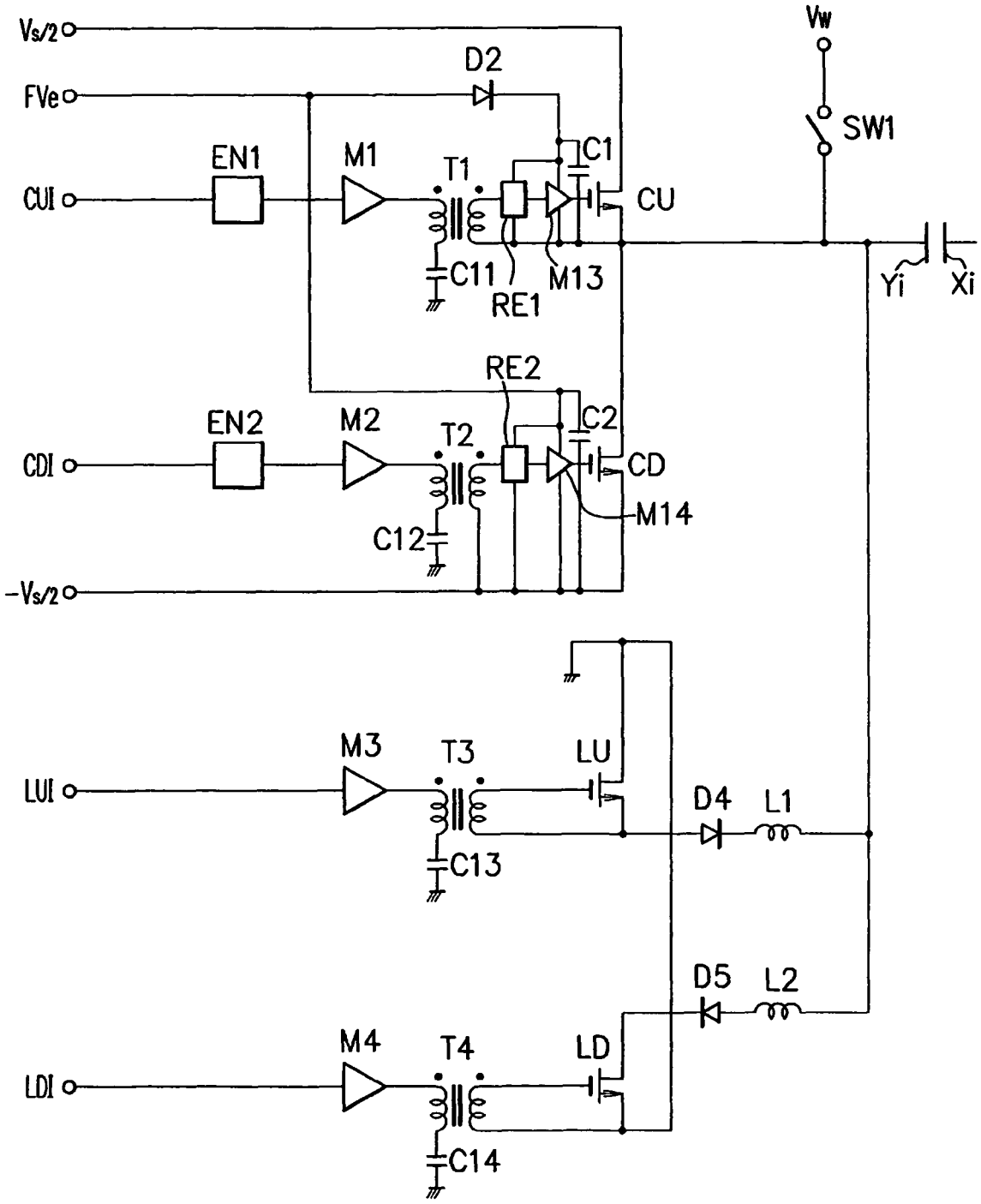
FIG. 11 shows a circuit diagram of an example of configuration of the Y common driver according to the fifth embodiment of the present invention.

FIG. 11 shows a circuit diagram of an example of configuration of the Y common driver (Y sustain drive circuit) 5 shown in FIG. 1 according to the fifth embodiment of the present invention. The circuit shown in FIG. 11 is basically the same as the circuit shown in FIG. 8, and different in the following point.

The circuit shown in FIG. 8 supplied to the Y electrode Yi a sustaining pulse with a high level of Vs and a low level of the ground, but the circuit shown in FIG. 11 supplies to the Y electrode Yi a sustaining pulse with a high level of +Vs/2 and a low level of −Vs/2. The source voltage +Vs/2 is supplied to the drain of the MOS transistor CU. The source voltage −Vs/2 is supplied to the secondary winding of the transformer T2, the demodulation circuit RE2, the amplifying circuit M14, the capacitor C2 and the source of the MOS transistor CD.

As compared to the circuit shown in FIG. 8, the present embodiment has a difference wherein two source voltages +Vs/2 and −Vs/2 are used as the sustain source voltage. The circuit shown in FIG. 11 can eliminate the capacitor C6 for the electric power recovery shown in FIG. 8. The drain of the MOS transistor LU and the source of the MOS transistor LD are connected to the ground. By using the transformers T1 and T2 as drive circuits for the MOS transistors CU and CD, input signals with the ground pertaining to the input terminals CUI and CDI being reference can be easily converted into driving pulses with the reference voltage being reference (the source voltage of the MOS transistor or the like.) of the output elements (the MOS transistors) CU and CD. Other operations are similar to those of the circuit shown in FIG. 8.

Sixth Embodiment

Figure 12:
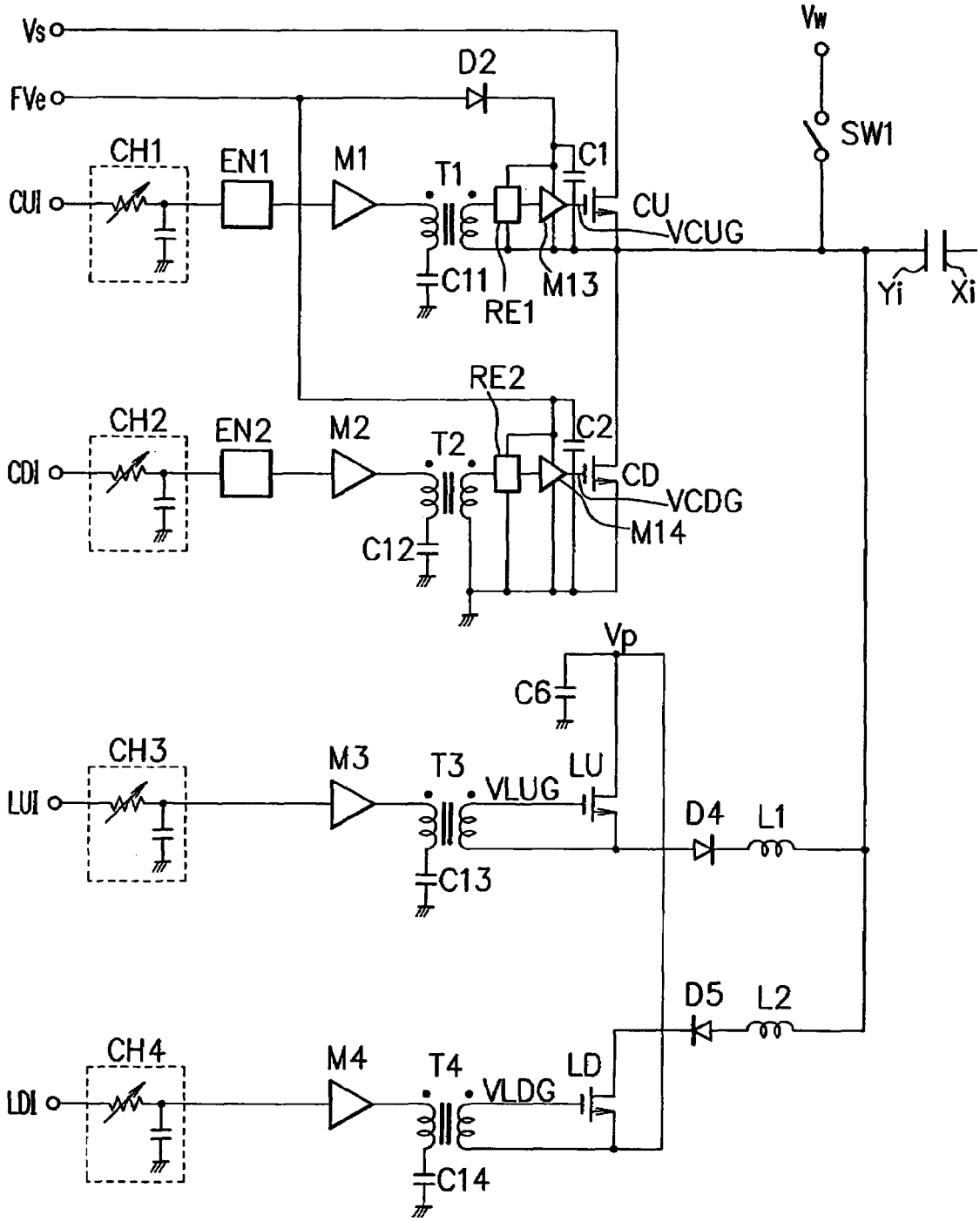
FIG. 12 shows a circuit diagram of an example of configuration of the Y common driver according to the sixth embodiment of the present invention.

FIG. 12 shows a circuit diagram of an example of configuration of the Y common driver (Y sustain drive circuit) 5 shown in FIG. 1 according to the sixth embodiment of the present invention. The circuit shown in FIG. 12 is basically the same as the circuit shown in FIG. 8, and different in a point where input and output delay time adjustment circuits CH1, CH2, CH3, and CH4 are added. The input and output delay time adjustment circuits CH1, CH2, CH3, and CH4 are composed of a variable resistor and a capacitor, and by changing a resistance value of the variable resistor a delay time of output signal from input signal can be adjusted.

The input and output delay time adjustment circuit CH1 is connected between the input terminal CUI and the modulation circuit EN1 to delay the input signal from the input terminal CUI and output to the modulation circuit EN1. The input and output delay time adjustment circuit CH1 is connected between the input terminal CDI and the modulation circuit EN2 to delay the input signal from the input terminal CDI and output to the modulation circuit EN2. The input and output delay time adjustment circuit CH3 is connected between the input terminal LUI and the amplifying circuit M3 to delay the input signal from the input terminal LUI and output to the amplifying circuit M3. The input and output delay time adjustment circuit CH4 is connected between the input terminal LDI and the amplifying circuit M4 to delay the input signal from the input terminal LDI and output to the amplifying circuit M4.

The input and output delay time adjustment circuits CH1 to CH4 adjust delay times in the input and output delay time adjustment circuits CH1 to CH4 so as to keep a constant value the time difference (input output delay time) between the rising times of signals from the input terminals CUI, CDI, LUI, and LDI and the rising times of driving pulses (gate voltages) VCUG, VCDG, VLUG, and VLDG of MOS transistors CU, CD, LU, and LD. Since signal transmission is done with high speed by using transformers T1 to T4 in the present embodiment, a variation in delay time prior to the adjustment is small as compared to the case of using ICs shown in FIG. 2. Therefore the adjustment of the input output delay time can be done with higher precision.

In the present embodiment, the input and output delay time adjustment circuits CH1 to CH4 utilize a time constant circuit composed of a resistor and a capacitor, and the adjustments in delay times are done by adjusting the resistor values, but other circuits may be used.

Furthermore, even in cases where the input and output delay time adjustment circuits CH1 to CH4 are used in the input part of the circuits of the embodiments other than the third embodiment (FIG. 8), the adjustment in delay time can be done with higher precision.

As described above, in the first to the sixth embodiments, the transformers with good high speed characteristics are used in the pre-drive circuit. The transformer is, however, difficult to transmit low frequency signal. In order to avoid the saturation of the transformer, it has to be large in size, which results in increase in a scale of the circuit. Then, this problem were solved by following two methods.

(1) The sustaining pulse signal (high frequency signal) is supplied through a transformer, and low frequency signal which is used as an option pulse and the like is supplied through an auxiliary circuit.

(2) By providing a modulation circuit on a primary winding side of the transformer and a demodulation circuit on a secondary winding side of the transformer, a low frequency signal is converted into a high frequency signal, and then transmitted and regenerated to an original drive signal on the secondary winding side of the transformer.

According to the first to sixth embodiments, a plasma display device and a capacitive load driving circuit can be provided with less amount of variation in delay time without doing a phase adjustment.

Furthermore, even in a case of doing the phase adjustment, an adjustment can be done with higher precision as compared to the circuit shown in FIG. 2, and an increase in sustaining pulse number, an improvement in electric power recovery efficiency, and an enlargement in drive margin in the ALIS method can be realized.

The ALIS method is explained here. The plasma display device has, as shown in FIG. 1, the X electrode Xi and the Y electrode Yi which are arranged alternatively, and the Y electrode Yi exists on both sides of the X electrode Xi. In the plasma display device shown in FIG. 1 the X electrode Xi generates a sustain discharge only between the Y electrode Yi present in neighborhood on one side. For example, a sustain discharge is generated between the X electrode X1 and the Y electrode Y1, and a sustain discharge is generated between the X electrode X2 and the Y electrode Y2. On the other hand, in the ALIS method, the X electrode Xi generates a sustain discharge between the Y electrodes Yi present on both sides. For example, in the first field, a sustain discharge generates between the X electrode X1 and the Y electrode Y1, and in the second field a sustain discharge generates between the X electrode X1 and the Y electrode Y2.

When due to the delay time of the circuit element the form and the timing of the sustaining pulse are deviated, there is increased the probability that there is no carrying out any normal operation. Conventionally, a difference ΔVs between the maximum value Vs(max) and the minimum value Vs(min) of the source voltage Vs within which an operation can be done is referred to as a drive margin. When due to the delay time of the circuit element the form and the timing of the sustaining pulse are deviated, the drive margin ΔVs is decreased. This means that the stability of the device decreases.

Furthermore, in the ALIS method, a discharge does not generate between neighboring electrodes applied by the same voltage, but if the timings of applying voltages do not coincide, a discharge happens temporally on the display line which is not to be displayed, the wall charges stored during the address period decrease, and a case happens where a normal display is prohibited from occurring.

There is a problem as described above, where the delay time of each circuit elements in the sustain circuit scatters, in accordance with this, deviations of on/off timing and the form of the sustaining pulse are generated, and then a power consumption increases and a miss operation happens. According to the first to sixth embodiments, even by the ALIS method, a sustain circuit without deviations of the on-timing and the form of the sustaining pulse can be realized, and then a plasma display device with low power consumption and no miss operation can be realized.

By the way the MOS transistor CU2 can be composed of a P-channel MOS transistor or a PNP junction bipolar transistor. The MOS transistors CU, CD, CD2, LU, LD can be composed of an N-channel MOS transistor, an NPN junction bipolar transistor or an IGBT. Furthermore, the MOS transistors CU, CU2, CD, CD2, LU, LD may be output elements other than those described above.

All of the above embodiments merely indicate concrete examples in utilizing this invention. Technological area of the present invention should not be understood limitedly by this description. That is, the present invention can be practically used in various forms without deviating from the technological concepts and their main characteristics.

Since the first output element inputs an input signal by using a transformer, the first output element can be driven with reduced variation in delay time and without carrying out any phase adjustment. Even in a case where a phase adjustment and the like is done, it is possible to adjust with higher precision, to increase the number of the sustaining pulse, and to increase more the electric power recovery efficiency. In a case where ALIS method is used, it is able to widen the driving margin more.

What is claimed is:

1. A plasma display device, comprising:

a first display electrode;

a second display electrode adapted to cause a discharge to occur between the first display electrode and the second display electrode;

a first display electrode drive circuit to apply a discharge voltage to the first display electrode; and a second display electrode drive circuit to apply a discharge voltage to the second display electrode, wherein the first display electrode drive circuit has a first output element, a second output element and a transformer, and with supplying a first signal from a first input terminal to one end of a primary winding of the transformer, the first display electrode drive circuit connects one end of a secondary winding of the transformer to a control terminal of the first output element, connects the other end of the secondary winding to the first display electrode, and applies a first electric potential to the first display electrode by turning on the first output element, and the first display electrode drive circuit supplies the first signal to a control terminal of the second output element not through the transformer, and applies the first electric potential to the first display electrode by turning on the second output element.

2. The plasma display device according to claim 1, wherein the first and second output elements supply a high level electric potential as the first electric potential, the first display electrode drive circuit further comprises a third output element a fourth output element and a second transformer, and with supplying a second signal from a second input terminal to one end of a primary winding of the second transformer, the first display electrode drive circuit connects one end of a secondary winding of the second transformer to a control terminal of the third output element, connects the other end of the secondary winding to a low level electric potential, and applies the low level electric potential to the first display electrode by turning on the third output element, and the first display electrode drive circuit supplies the second signal to a control terminal of the fourth output element not through the second transformer, and applies the low level electric potential to the first display electrode by turning on the fourth output element.

3. The plasma display device according to claim 2, further comprising:

the first coil connected to the first display electrode;

a fifth output element inputting a third signal from a third input terminal through a third transformer, and connecting a second electric potential point to the first display electrode through the first coil in accordance with the third signal;

a first diode adapted to cause a forward current to flow from the second electric potential point to the first display electrode through the fifth output element and the first coil;

a second coil connected to the first display electrode;

a sixth output element inputting a fourth signal from a fourth input terminal through a fourth transformer, and connecting the second electric potential point to the first display electrode through the second coil in accordance with the fourth signal; and a second diode adapted to cause a forward current to flow from the first display electrode to the second electric potential point through the sixth output element and the second coil.

* * * * *

UNITED STATES PATENT AND TRADEMARK OFFICE

CERTIFICATE OF CORRECTION

PATENT NO. : 8,203,509 B2
APPLICATION NO. : 12/218061
DATED : June 19, 2012
INVENTOR(S) : Makoto Onozawa et al.

It is certified that error appears in the above-identified patent and that said Letters Patent is hereby corrected as shown below:

Column 15, Line 22, In Claim 2, delete "third output element" and insert
-- third output element, -- therefor.

Signed and Sealed this
Fourteenth Day of August, 2012

David J. Kappos

David J. Kappos
*Director of the United States Patent and Trademark Office*